US007810429B1

(12) United States Patent
Buckley et al.

(10) Patent No.: US 7,810,429 B1
(45) Date of Patent: Oct. 12, 2010

(54) CONSUMABLE FLASH TUBE

(75) Inventors: Michael E. Buckley, Dahlgren, VA (US); Donald R. McClure, King George, VA (US); Jesse L. East, Jr., Dahlgren, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 06/358,131

(22) Filed: Mar. 15, 1982

(51) Int. Cl.
*F42B 3/18* (2006.01)

(52) U.S. Cl. ..... 102/202; 102/202.2

(58) Field of Classification Search ..... 102/202, 102/202.2, 202.1, 204, 275.11, 382, 322
See application file for complete search history.

(56) References Cited

U.S. PATENT DOCUMENTS 2,436,826 A * 3/1948 Regad et al. ..... 102/204
3,151,447 A * 10/1964 Bornstein ..... 102/202
3,182,595 A * 5/1965 Hassmann ..... 102/202
3,392,673 A * 7/1968 King ..... 102/202
3,645,206 A 2/1972 Quinlan et al. ..... 102/40
3,696,749 A 10/1972 Scanlon ..... 12/49.7
3,828,676 A 8/1974 Junker ..... 102/39

* cited by examiner

*Primary Examiner*—J. Woodrow Eldred
(74) *Attorney, Agent, or Firm*—Frederick A. Wein Esq; Kenneth E. Walden, Esq; Gerhard W. Thielman Esq

(57) ABSTRACT

A consumable flash tube for encapsulating igniter material in the propellant beds of propelling charges or rocket motors. The flash tube is constructed of a combustible, plastic material such as cellulose nitrate plastic or ethyl cellulose plastic. The combustible material is furnished with a filler of electrical charge dissipating material which renders the flash tube conductive. The conductive flash tube functions as an environmental housing and additionally as a grounded electrical conductor or Faraday shield so as to bleed off any inadvertent electrical charge presented to the flash tube and thus limit the charge transferred to the igniter material. Formation of the flash tube is by continuous extrusion of a mixture of the plastic material and electrical charge dissipating material into the shape of a hollow tube. After curing of the extruded tube, one end of the tube is flared to allow joining of the tube to a primer after the igniter material is positioned in the flash tube.

20 Claims, 1 Drawing Sheet

CONSUMABLE FLASH TUBE

BACKGROUND OF THE INVENTION

The present invention relates to an igniter having a consumable flash tube for encapsulating igniter material and more particularly to an igniter having a flash tube for encapsulating igniter material for the propellant beds in propelling charges or rocket motors which functions as an environmental housing and additionally functions as a grounded electrical conductor or Faraday shield to bleed off any inadvertent electrical charge presented to the flash tube.

Prior art flash tubes or ignition devices for igniting propellant beds commonly consisted of a high strength, seamless, perforated steel tube for encapsulating the igniter material. The use of a steel tube was required to provide pressure confinement for the selected igniter material, black powder, and thereby increase burning rate so as to obtain the pressure buildup required for ignition. The steel tube is normally embedded in the propellant bed to be ignited. The steel tubes are expensive in material cost and require accurate and time consuming machining to tolerance. In addition, the steel tubes require special quality assurance inspection techniques to detect imperfections which could cause tube rupture during ignition and result in improper performance of the ignition assembly and propellant bed. These disadvantages can be overcome by encapsulating a fast burning igniter material, which does not require pressure confinement, in a consumable flash tube which is inexpensive and does not require elaborate and time consuming machining or inspection techniques. A fast burning igniter material does not require pressure confinement and thus allows a consumable flash tube to be used in the igniter.

Prior art consumable flash tubes are best typified by the devices disclosed in U.S. Pat. Nos. 3,645,206, to Quinlan et al, 3,696,749, to Scanlon, and 3,828,676, to Junker. The device of Quinlan et al discloses a consumable ignition system which ignites a molded charge of single based propellant encompassing a projectile. Quinlan et al fails to disclose either a consumable flash tube embedded in a propellant bed, per se, or a flash tube functioning as an electrical conductor or Faraday shield.

The device of Scanlon discloses an expendable cartridge provided with a consumable flash tube containing a booster propellant charge of black powder that is used to ignite the main charge. Scanlon does not disclose a flash tube which functions as an electrical conductor or Faraday shield so as to bleed off inadvertent electrical charge presented to the flash tube and thus limit the charge transferred to the igniter material.

The disclosure of Junker teaches a consumable explosive cartridge having a primer encased in a flexible nitrocellulose capsule. The capsule has a greater volume than the primer so as to facilitate safe handling of the primer during assembly. The larger volume of the capsule ensures that no pressure will be exerted on the primer during the assembly process and thus the cartridge is stable in regard to inadvertent physical shock but is subject to detonation when compressed in an appropriate firing chamber. Again, the device of Junker fails to disclose a flash tube provided with electrical charge dissipating material which functions as a grounded electrical conductor or Faraday shield to bleed off any inadvertent electrical charge presented to the flash tube and thus limit the charge transferred to the igniter.

SUMMARY OF THE INVENTION

Accordingly, there is provided in the present invention an igniter having a consumable flash tube for encapsulating igniter material embedded in the propellant beds of propelling charges or rocket motors.

The flash tube is constructed of a combustible, plastic material such as cellulose nitrate plastic or ethyl cellulose plastic. The combustible, plastic material is furnished with a filler of electrical charge dissipating material, such as acetylene carbon black, or other electrolytic grade graphite, which renders the flash tube conductive. The conductive flash tube functions as an environmental housing and functions additionally as a grounded electrical conductor or Faraday shield so as to bleed off inadvertent electrical charge presented to the flash tube and thus limit the charge transferred to the igniter material.

Formation of the flash tube is accomplished by continuously extruding the mixture of the plastic material and the electrical charge dissipating material to form a hollow tube. After curing of the extruded tube, one end of the tube is flared to provide for joining of the tube to the remaining primer components after the igniter material is positioned in the flash tube. The igniter material may be any ignition material which does not require pressure confinement to function. In addition, the igniter material should not possess hydrophilic properties.

OBJECTS OF THE INVENTION

It is an object of the present invention to provide an igniter having an inexpensive, consumable flash tube to encapsulate igniter material for the propellant beds of propelling charges and rocket motors.

Another object of the present invention is to provide a consumable flash tube which can be manufactured without expensive and time-consuming machining and inspection.

Another object of the present invention is to provide a consumable flash tube which functions as an environmental housing for encapsulating igniter material for the propellant beds of propelling charges and rocket motors.

A further object of the present invention is to provide a consumable flash tube which can be manufactured by continuous extrusion.

A still further object of the present invention is to provide a consumable flash tube which functions as a grounded electrical conductor or Faraday shield to bleed off inadvertent electrical charge generated by the propellant bed in which it lies or igniter agent which it houses at a rate which prevents the substantial buildup of charge and thus limits internal charge buildup and the charge transferred to the igniter material.

A further object of the present invention is to provide a consumable flash tube which allows for uniform combustion of both the igniter material and propellant bed of a propelling charge or rocket motor.

A still further object of the present invention is to provide an igniter having a consumable flash tube which has a limited impact upon the performance of the propellant bed or the combustion by-products by virtue of the combustion of the flash tube.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1:
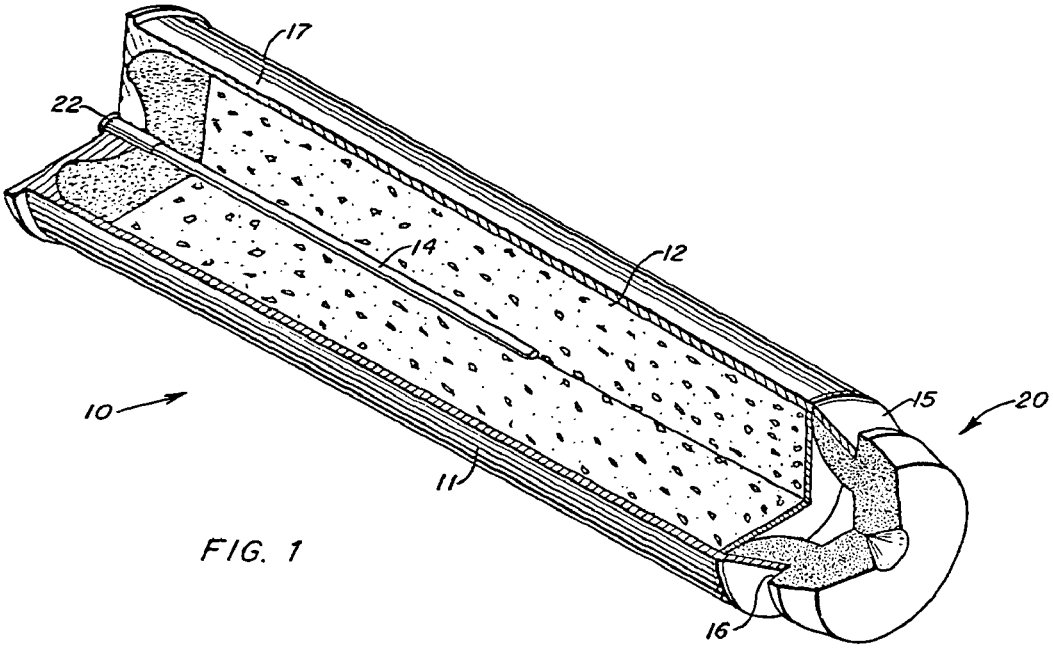
FIG. 1 illustrates an isometric view in partial cutaway of a projectile cartridge incorporating the flash tube of the present invention.

Referring to FIG. 1, there is illustrated an isometric view in partial cutaway of cased ammunition or propelling charge 10 incorporating flash tube 14 of the subject invention. Propelling charge 10 is formed with tapered, cylindrical body 11 which encloses a propellant bed 12. The body is formed with a forward end 15 and an after end 17 with forward end 15 being closed by cartridge case closure plug 20. Forward end 15 is provided with a tapered portion 16 which encircles and attaches closure plug 20 to body 11.

Figure 2:
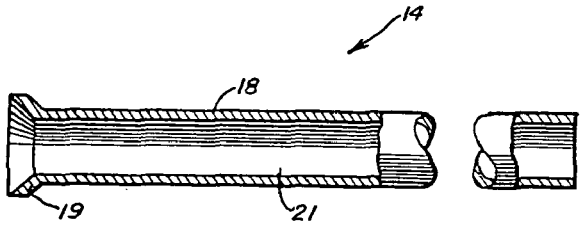
FIG. 2 illustrates in partial cross-section the flash tube of the present invention.

Referring to FIG. 2, there is illustrated a side view of consumable flash tube 14 in partial cross-section. The flash tube is furnished with a cylindrical, elongated body 18 and provided with an expanded end portion 19. The cylindrical body of tube 14 encloses a cylindrical hollow 21 which extends continuously through the tube in which is positioned the igniter material (not shown).

The consumable flash tube of the subject invention is constructed of a combustible, plastic material such as cellulose nitrate plastic, ethyl cellulose plastic or similar material which is consumable upon ignition of the igniter material.

The consumable, plastic material is furnished with a filler of electrical charge dissipating material which, when grounded through primer head stock 22, renders flash tube 14 conductive. The conductive flash tube functions as a grounded electrical conductor or Faraday shield to bleed off any inadvertent electrical charge above 1,000 volts so as to limit the electrical charge transferred to the igniter material and thus prevent inadvertent initiation of the igniter material. During on-board storage of cartridge case 10, any inadvertent electrical charge created by handling, storage, raising in height, tribo-electric effect, storms or similar occurrences, will be prevented from propagating to the igniter material by the conductive properties of flash tube 14.

The combustible material, cellulose nitrate plastic, is a composition of approximately 75% cellulose nitrate and 25% camphor. Dibutylphthalate may be substituted for the camphor in the cellulose nitrate plastic.

The electrical charge dissipating material which is provided as a filler for the combustible material may be acetylene carbon black, other carbon blacks, other electrolytic grade graphites, or other conductive fillers such as lithium chloride, lead stearate, cupric salicylate or other granular conductive material which is chemically compatible with the plastic material and does not degrade the mechanical properties of the plastic material. Each of the preceding electrical charge dissipating materials can be added to the plastic material in sufficient amounts to render the consumable flash tube conductive, without degrading the plastic characteristic of the consumable plastic material, so as to create a Faraday shield for the igniter material encapsulated in flash tube 14. By way of example, granular acetylene carbon black added to the plastic material in a ratio of approximately 10% by weight of carbon black to approximately 90% plastic material will render the flash tube sufficiently conductive. A granular type filler is preferred because of the high surface area to volume ratio, although it is to be understood that other types of filler, besides granular, may be used.

The buildup of electrostatic charge in a material is a highly transient phenomena—limited only by the resistivity of an involved region or by dielectric breakdown for larger voltage and charge levels. The resistivity of a material will determine the rate at which bleed off of electrostatic charge will occur. If the bleed off is at least of the order of the charge buildup rate for a given mode of charge generation, little charge will be allowed to accumulate. For most charge generation modes a resistivity of 10 MΩ→100 MΩ is generally considered sufficient for the prevention of appreciable charge, i.e., that charge considered to be hazardous in the handling of explosives. Flash tube 14, incorporating the electrical charge dissipating material, provides an adequately conductive container for protection of the igniter material from any externally generated charge.

Formation of flash tube 14 is accomplished by continuously extruding the mixture of the plastic material and the electrical charge dissipating material to form a hollow, cylindrical tube. Alternatively, flash tube 14 can be formed by rolling the mixture on a mandrel to obtain a seamed tube. The seam of the tube is then closed with a suitable adhesive. After curing of the mixture, one end of the tube is flared, illustrated at 19 in FIG. 2, to provide for joining of the tube to the primer head stock, illustrated at 22 in FIG. 1. The igniter material is positioned in cylindrical hollow 21, of FIG. 2, and may be any ignition material that does not require pressure confinement to function properly or have hydrophilic properties.

It is thus apparent that the disclosed consumable flash tube for encapsulating igniter material in the propellant beds of propelling charges or rocket motors provides a flash tube which can be manufactured by continuous extrusion, without expensive and time-consuming machining and inspection. The consumable flash tube provides for uniform combustion of both the encapsulated igniter material and propellant bed of the propelling charges, with minimal effect on the combustion process or combustion by-products and functions as a grounded electrical conductor or Faraday shield to bleed off any inadvertent electrical charge presented to the flash tube and thus limit the electrical charge transferred to the igniter material.

Many obvious modifications of the specific invention, other than those set forth above, will readily come to mind to one skilled in the art having the benefit of the teachings presented in the foregoing description and the accompanying drawings of the subject invention and hence it is to be understood that such modifications are included within the scope of the appended claims.

What is claimed as new and desired to be secured by Letters Patent of the United States is:

1. A consumable flash tube encapsulating igniter material for igniting propellant beds, comprising:

consumable means; and electrical charge dissipation means dispersed in the consumable means and functioning as a Faraday shield to bleed off inadvertent electrical charge presented to the flash tube.

2. The flash tube of claim 1 wherein the consumable means is cellulose nitrate plastic.

3. The flash tube of claim 1 wherein the consumable means is ethyl cellulose plastic.

4. The flash tube of claim 1 wherein the electrical charge dissipation means is acetylene carbon black.

5. The flash tube of claim 1 wherein the electrical charge dissipation means is carbon black.

6. The flash tube of claim 1 wherein the electrical charge dissipation means is lithium chloride.

7. The flash tube of claim 1 wherein the electrical charge dissipation means is lead stearate.

8. The flash tube of claim 1 wherein the electrical charge dissipation means is cupric salicylate.

9. The flash tube of claim 1 wherein the electrical charge dissipation means is electrolytic grade graphite.

10. The flash tube of claim 1 wherein the electrical charge dissipation means is a granular conductive filler.

11. The flash tube of claim 1 wherein the consumable means is a composition of cellulose nitrate and camphor.

12. The flash tube of claim 11 wherein the consumable means is a composition of approximately 75% cellulose nitrate and 25% camphor.

13. The flash tube of claim 1 wherein the consumable means is a composition of cellulose nitrate and dibutylphthalate.

14. The flash tube of claim 13 wherein the consumable means is a composition of approximately 75% cellulose nitrate and 25% dibutylphthalate.

15. The flash tube of claim 1 wherein the electrical charge dissipation means is a grounded electrical conductor that bleeds off inadvertent electrical charge and limits the charge transferred to the igniter material.

16. The flash tube of claim 1 wherein the electrical charge dissipation means is a grounded electrical conductor.

17. A consumable flash tube containing igniter material for igniting a propellant bed, said flash tube being constructed of a composition comprising:

approximately 90% ethyl cellulose plastic, said plastic being consumed upon ignition of the igniter material; and approximately 10% electrical, charge dissipation means, said means being a grounded electrical conductor to bleed off inadvertent electrical charge presented to the flash tube and thus limit the charge presented to the igniter material.

18. A consumable flash tube containing igniter material for igniting a propellant bed, said flash tube being constructed of a composition comprising:

approximately 90% cellulose nitrate plastic, said plastic being consumed upon ignition of the igniter material; and approximately 10% electrical charge dissipation means, said means being a grounded electrical conductor to bleed off inadvertent electrical charge presented to the flash tube and thus limit the charge presented to the igniter material.

19. The flash tube of claim 18 wherein the cellulose nitrate plastic is approximately 75% cellulose nitrate and 25% camphor.

20. The flash tube of claim 18 wherein the cellulose nitrate plastic is approximately 75% cellulose and 25% dibutylphthalate.

* * * * *